US009624775B2

(12) United States Patent
Rix

(10) Patent No.: US 9,624,775 B2
(45) Date of Patent: Apr. 18, 2017

(54) DEVELOPMENTS IN OR RELATING TO ROTOR BALANCING

(71) Applicant: ROLLS-ROYCE PLC, London (GB)

(72) Inventor: Andrew Iain James Rix, Bristol (GB)

(73) Assignee: ROLLS-ROYCE plc, London (GB)

( * ) Notice: Subject to any disclaimer, the term of this patent is extended or adjusted under 35 U.S.C. 154(b) by 328 days.

(21) Appl. No.: 14/291,477

(22) Filed: May 30, 2014

(65) Prior Publication Data

US 2015/0345295 A1 Dec. 3, 2015

(51) Int. Cl.

| | |
|---|---|
| ***F01D 5/02*** | (2006.01) |
| ***F01D 5/26*** | (2006.01) |
| ***F01D 5/30*** | (2006.01) |

(52) U.S. Cl.

CPC ..... *F01D 5/027* (2013.01); *F01D 5/26* (2013.01); *F01D 5/3007* (2013.01); *F01D 5/3092* (2013.01); *F05D 2220/32* (2013.01); *F05D 2260/15* (2013.01); *Y10T 29/49323* (2015.01)

(58) Field of Classification Search

CPC ..... F01D 5/027; F01D 5/3092; F01D 5/3007; F01D 5/26; F01D 5/326; Y10T 29/49323; F05D 2260/15; F05D 2220/32; F05D 2220/96; F05D 2220/961; F16F 15/34

USPC ..... 416/144, 205, 219 R, 220 R, 220 A, 1, 416/202, 203, 198 R, 199, 200 R, 201 R, 416/500

See application file for complete search history.

(56) References Cited

U.S. PATENT DOCUMENTS

| | | | | |
|---|---|---|---|---|
| 5,123,813 | A | 6/1992 | Przytulski et al. | |
| 5,584,659 | A | 12/1996 | Schmidt | |
| 6,354,780 | B1 * | 3/2002 | Davis | F01D 5/027 414/146 |
| 8,348,620 | B2 * | 1/2013 | Dejaune | F01D 5/3015 416/218 |
| 2010/0135775 | A1 * | 6/2010 | Masserey | F01D 5/22 415/173.1 |

FOREIGN PATENT DOCUMENTS

| | | |
|---|---|---|
| EP | 0 609 979 | 8/1994 |
| EP | 1 452 687 A2 | 9/2004 |
| EP | 1 995 467 A1 | 11/2008 |
| EP | 2 677 119 A2 | 12/2013 |
| GB | 2 410 531 A | 8/2005 |

OTHER PUBLICATIONS

Sep. 2, 2014 Search Report issued in European Application No. EP 14 17 0640.

Search Report issued in British Patent Application No. 0903625.2 dated Jun. 2, 2009.

Search Report issued in British Patent Application No. 0903625.2 dated Oct. 13, 2009.

* cited by examiner

*Primary Examiner* — Michael R Reid
(74) *Attorney, Agent, or Firm* — Oliff PLC

(57) ABSTRACT

A method of reducing dynamic imbalance in a bladed rotor assembly by axially adjusting one or more of the blades so as to redistribute mass along the geometric axis of the assembly. The blades may be axially adjusted to form a counterbalancing couple. Additional correction masses may be added for supplemental correction of couple imbalance or residual static imbalance in the bladed rotor assembly. The invention offers a reduction in the weight penalty associated with conventional balancing corrections carried out on the bladed rotor assembly.

5 Claims, 5 Drawing Sheets

DEVELOPMENTS IN OR RELATING TO ROTOR BALANCING

The present invention relates to rotor balancing and, in particular, to a method of reducing dynamic imbalance in a bladed rotor assembly having axial blade fixings.

The invention is particularly suitable for use in weight-critical applications such as in bladed rotor assemblies in gas turbines for aerospace applications. The invention is not, however, limited to gas turbine applications.

In a bladed rotor assembly such as a fan blade assembly in a gas turbine, the blades are manufactured separately and then assembled together on one or more rotor discs using suitable blade fixings. The blade fixings generally take the form of either circumferential blade fixings, where a root portion of each blade is located in a circumferential slot machined out of the rotor disc, or axial blade fixings, where the blades comprise an axial root portion which slides axially into respective axial mounting slots in the rotor disc.

During manufacture of the components making up the bladed rotor assembly, efforts are made to minimise mass imbalances in the individual components. Nevertheless, mass imbalances will tend to arise in the completed assembly, for example due to manufacturing tolerances on the blades. Consequently, the assembly as a whole must undergo an initial balancing operation in order to prevent subsequent stress and vibration during operation of the bladed rotor assembly.

In order to balance the final assembly, a two plane balancing correction is typically carried out by addition or removal of mass from the assembly in two spaced apart correction planes which extend perpendicular to the geometric axis of the assembly. In either case this involves a weight penalty, either from the direct effect of adding a balancing mass, or because the removal of material means that sacrificial balancing lands need to be provided which add to the weight of the assembly. The weight penalty can in principle be reduced by increasing the separation of the correction planes along the geometric axis of rotation to increase the coupling moment of the balancing masses, but in practical terms this is often not viable due to space constraints. In addition, an increased separation of the balancing masses tends to increase bending of the rotor shaft at or near resonant frequencies of the rotor assembly. This bending of the rotor shaft can be reduced or nearly eliminated by using multi-plane balancing techniques, but again space constraints can make it difficult to provide multiple balancing lands, or sufficient space for mounting balancing masses in multiple planes.

It is an object of the present invention to seek to provide an improved method for reducing dynamic imbalance in a bladed rotor assembly having axial blade fixings.

According to the present invention there is provided a method of reducing dynamic imbalance in a bladed rotor assembly having axial blade fixings, wherein the reduction in dynamic imbalance is provided at least in part by axial adjustment of one or more of the blades so as to redistribute mass along the geometric axis of the assembly.

The reduction in dynamic imbalance may be provided at least in part by axially offsetting a pair of the blades so as to form a counterbalancing couple. In particular, the counterbalancing couple may be provided by axially offsetting a diametrically opposed pair of the blades.

The counterbalancing couple may be provided by axially offsetting a plurality of such pairs of blades.

The method may comprise providing a supplementary balancing correction by adding mass to, or removing mass from, the rotor assembly in one or more correction planes positioned along the geometric axis of rotation of the rotor.

The bladed rotor assembly may be a turbine assembly, compressor assembly or fan assembly for a gas turbine.

According to another aspect of the invention, there is provided a bladed rotor assembly having axial blade fixings, at least one of the blades being secured by an axial fixing arrangement comprising a set screw acting between the rotor disc and the blade for axially adjusting the position of the blade, and a biasing member acting between the blade and the rotor disc for holding the blade in axial position against the set screw.

Embodiments of the invention will now be described, by way of example, with reference to the accompanying drawings, in which.

Figure 1:
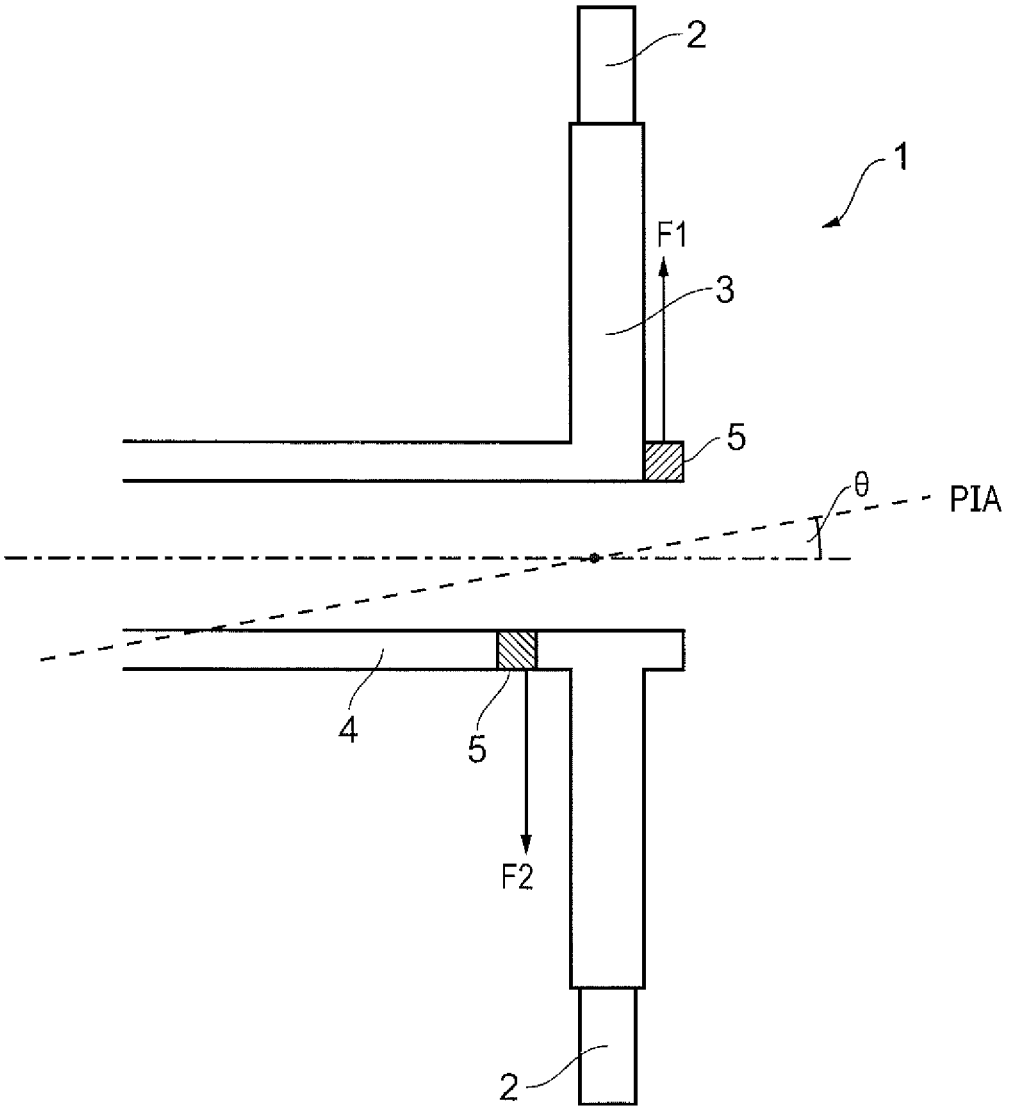
FIG. 1 is a schematic plan view of a bladed rotor assembly.
Figure 4:
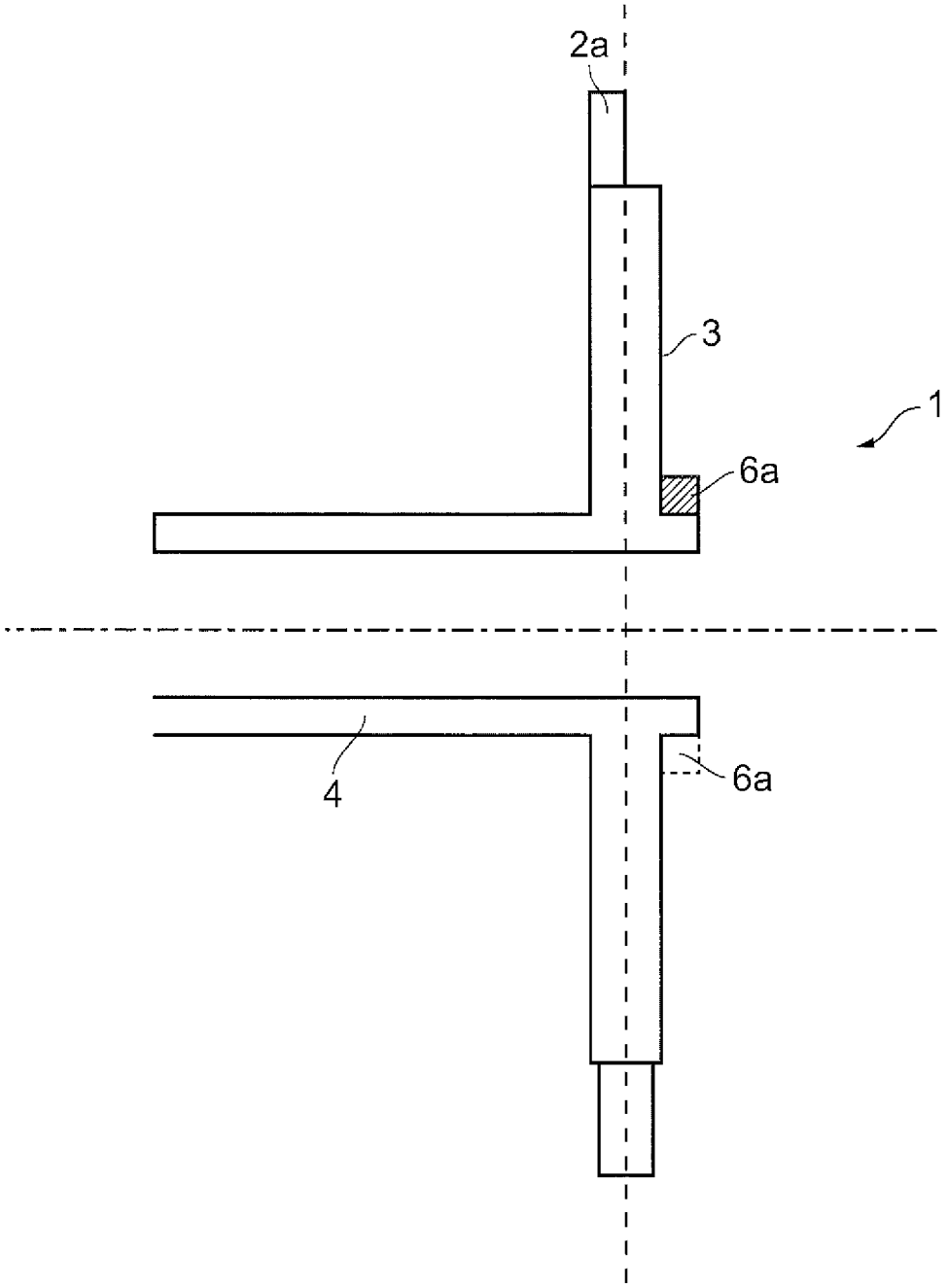
Figure 5:
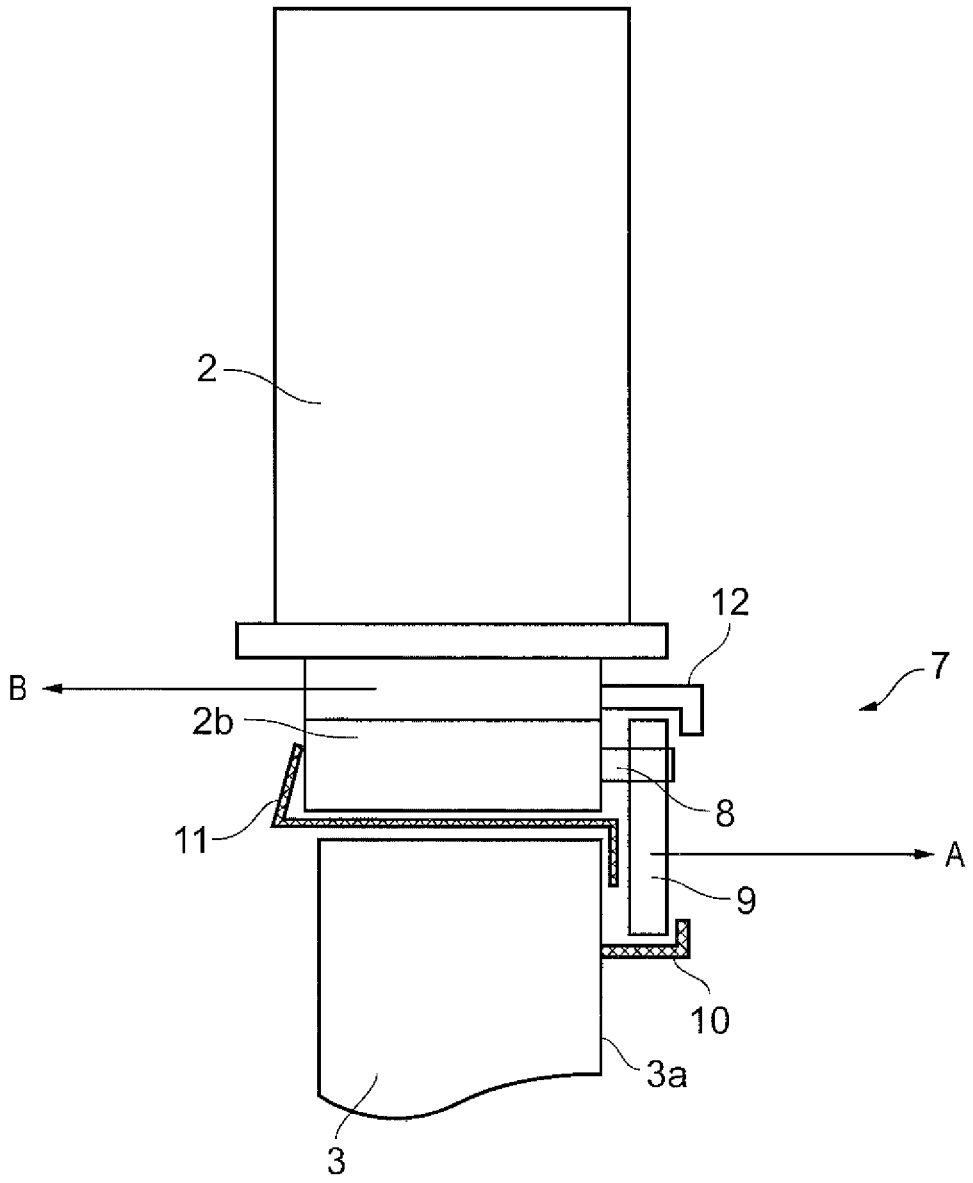

FIG. 4 is a view of corresponding to FIG. 1, illustrating use of a single axially-offset blade to form a counterbalancing couple with a correction mass, according to a further aspect of the present invention; and FIG. 5 is a schematic cross-sectional view through part of a bladed rotor assembly illustrating one possible axial fixing arrangement for allowing convenient axial adjustment of the blades.

FIG. 1 shows a fan assembly 1 for a gas turbine.

The fan assembly 1 comprises a plurality of separately manufactured blades 2 (only two of which are visible in FIG. 1) mounted on a rotor disc 3. The blades 2 incorporate axial root portions (not shown) which locate in corresponding axial slots machined out of the rotor disc 3. The rotor disc 3 is carried on a rotor shaft 4 which, in operation of the fan assembly 1, rotates about a centreline (CL) of the assembly (representing the geometric axis of rotation of the fan assembly 1).

Ideally, the centreline will coincide with a principal axis of inertia of the fan assembly, so that the fan assembly is dynamically balanced.

In practice, however, mass imbalances caused by manufacturing and fitting tolerances will tend to misalign the principal inertial axis with the centreline of the assembly, with the result that the final assembly will often suffer a dynamic imbalance.

In general, the dynamic imbalance in the final assembly will include a so-called "couple imbalance", wherein equal mass imbalances located in angular opposition to one another (ie 180° apart) form a 'couple', tending angularly to misalign the principal axis of inertia and the centreline.

FIG. 1 shows the fan assembly 1 having a couple imbalance caused by angularly opposed "heavy spots" 5, and the resulting angular misalignment θ of the principal axis of inertia (PIA) with the centreline. The couple imbalance is indicated by the arrows F1 and F2.

Figure 2:
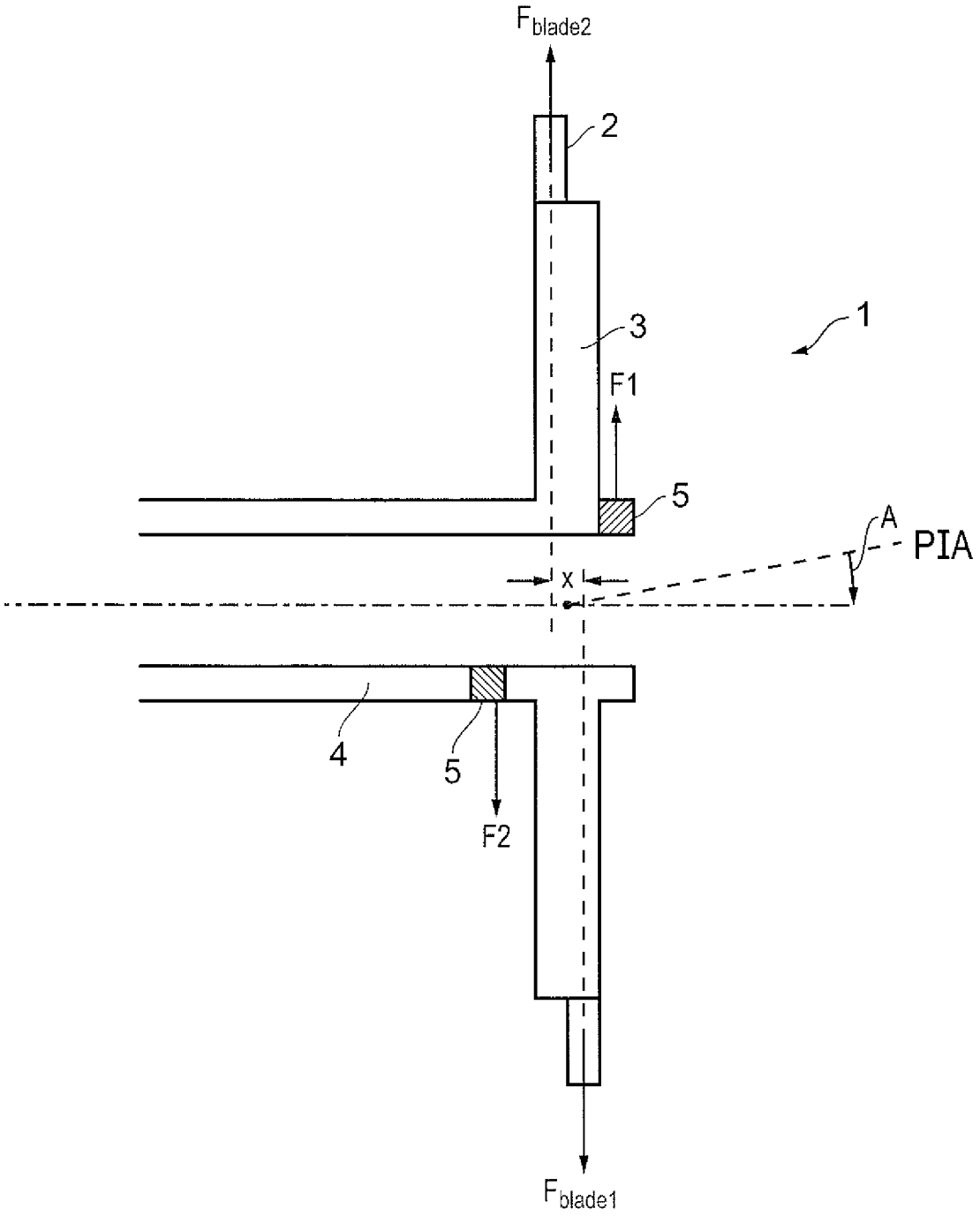
FIG. 2 is a view corresponding to FIG. 1, but illustrating axial offsetting of a pair of rotor blades in accordance with the present invention.

The dynamic imbalance of the fan assembly 1 is reduced in accordance with the present invention by axially offsetting a diametrically opposed pair of the blades 2, thus re-distributing mass along the centreline of the fan assembly 1, as shown in FIG. 2

The off-set blades 2 form a "two-plane" counterbalancing couple, indicated by the arrows $F_{blade1}$ and $F_{blade2}$ in FIG. 2, which counteracts the couple imbalance F1, F2. By controlling the moment arm of this counterbalancing couple ($F_{blade1}$, $F_{blade2}$), corresponding to the blade offset x, the principal axis of inertia may thus be realigned with the centreline, as indicated by the arrow A in FIG. 2.

It is envisaged that use of the blades 2 to form a counterbalancing couple will reduce the weight penalty associated with conventional two-plane balancing correction by addition or removal of mass from the assembly (in the latter case, by reducing the need for relatively heavy balancing lands).

Although in the embodiment shown in FIG. 2, a counterbalancing couple is formed by axially off-setting only a single pair of diametrically opposed blades 2, a plurality of pairs of blades may alternatively be axially-offset to form a corresponding, resultant counterbalancing couple. In this case, the magnitude and plane of the resultant counterbalancing couple may be determined for a given plurality of axially-offset blade pairs using conventional vector addition.

For a given rotor, a larger counterbalancing couple can be achieved using multiple blade pairs than would be possible using only a single blade pair. In addition, where multiple blade pairs are used to form a given counterbalancing couple, the axial off-set of each individual blade pair may be smaller than in the case where only a single blade pair is used to form the counterbalancing couple; this may be particularly advantageous in the case where large individual blade off-sets would compromise the aerodynamic efficiency of the rotor.

Figure 3:
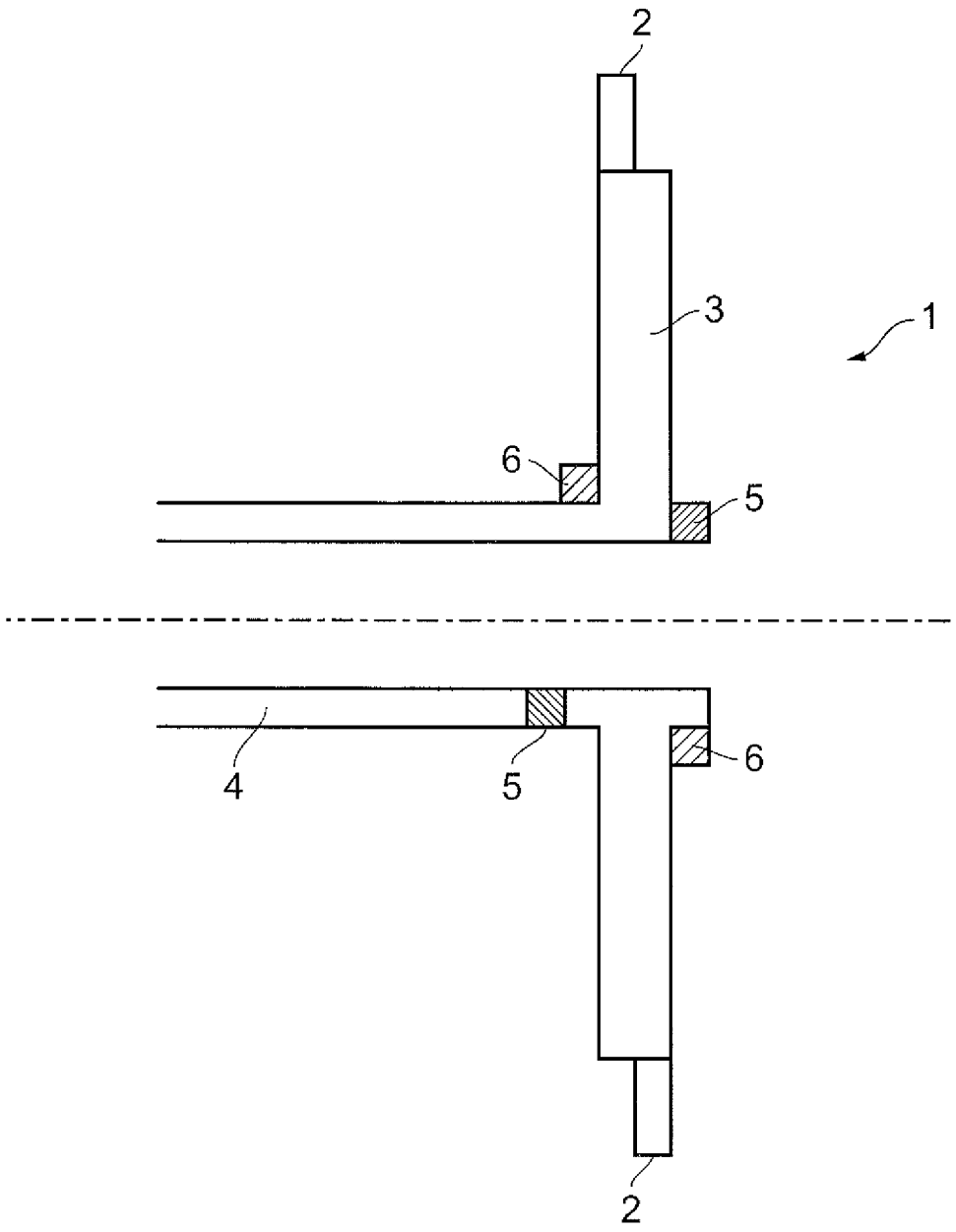
FIG. 3 is a view corresponding to FIG. 1, illustrating a supplementary two plane balancing correction on the bladed rotor assembly according to a further aspect of the present invention.

Depending upon the magnitude of the imbalance couple, it may be necessary to carry out a supplementary two plane balancing correction by adding correction masses 6 as shown in FIG. 3. Nevertheless, it will be appreciated that axial adjustment of the blades 2 to reduce the dynamic imbalance will allow for the correction masses 6 to be smaller than would ordinarily be the case carrying out a conventional two plane balancing correction. The use of additional correction masses may be required in particular where a counterbalancing couple is formed by off-setting a pair of blades 2 which are not diametrically opposed to one another.

The correction masses 6 may also be used to correct any static component of dynamic imbalance in the fan assembly 1, in particular where static imbalance in the bladed rotor assembly cannot be fully corrected by interchanging the location of the blades according to their inertial mass moment.

FIG. 4 shows an alternative embodiment for reducing a dynamic imbalance in a fan assembly 1 in accordance with the present invention, in this case following correction of a static imbalance in the fan assembly 1. Here, the static imbalance has been corrected by removing part of a balancing land 6*a* (the removed part of the balancing land 6*a* is indicated in phantom in FIG. 4), Resulting couple imbalance between the balancing land 6*a* and the centre of gravity $C_{disc}$ is corrected by axially off-setting single blade 2*a* to form a suitable counterbalancing couple. It will be appreciated here that the reduction in dynamic imbalance of the fan assembly 1 is provided at least in part by axial adjustment of the blade 2*a*.

FIG. 5 shows an axial fixing arrangement 7 for allowing convenient axial adjustment of a blade 2 on the rotor disc 3.

The axial fixing arrangement 7 comprises a set screw 8, in this case a grub screw, extending through a segmented lock plate 9 which sits in a circumferential channel 10 fixed on the rotor disc 3. A biasing member in the form of a spring clip 11 acts between the rotor disc 3 and the blade root 2*b* to hold the blade 2 against the set screw 8, thus locking the lock plate 9 against the side of the channel 10, as indicated by the arrow A. The set screw 8 thus acts between the rotor disc 3 and the blade 2 and can be used to axially adjust the position of the blade root 2*b* in the respective blade slot, as indicated by the arrow B. It will be appreciated that the spring clip 11 retains the blade 2 in axial position against the set screw 8, both during and in between axial adjustments. Though not essential, corresponding circumferential channel sections 12 may be provided on the rotor disc 3, in between blade slots (only one channel section 12 is visible in FIG. 5).

Any other suitable axial fixing arrangement may be provided for the blades. For example, the blades may be axially secured using an adjustable shim.

It will be appreciated that although embodiments of the invention have been described in relation to dynamic imbalances caused by irregular mass distribution within one or more components of the bladed rotor assembly, the present invention is equally suitable for reducing dynamic imbalances caused by misalignment between components within a bladed rotor assembly, including angular misalignment of a rotor disc.

The present invention finds particular application in high speed rotating machinery such as rotor assemblies in gas turbines, including fan assemblies, turbines assemblies and compressor assemblies. However, the invention is not intended to be limited to such applications and, in general, may be used on any suitable bladed rotor assembly having axial blade fixings.

What is claimed is:

1. A method of reducing a dynamic imbalance in a bladed rotor assembly, the bladed rotor assembly having a plurality of blades including a diametrically opposed pair of blades and axial blade fixings, wherein the reduction in dynamic imbalance is provided at least in part by a step of axially offsetting the diametrically opposed pair of blades with respect to each other along a geometric rotation axis of the bladed rotor assembly by axially adjusting one or more of the plurality of blades so as to redistribute mass along the geometric rotation axis of the bladed rotor assembly.

2. A method according to claim 1, wherein the axially offsetting step comprises the step of axially offsetting the two of the plurality of blades so as to form a counterbalancing couple, so as to, at least in part, reduce the dynamic imbalance in the bladed rotor assembly.

3. A method according to claim 2, wherein the two of the plurality of blades comprise a pair of blades and the bladed rotor assembly comprises a plurality of the pairs of blades, and wherein the axially offsetting step comprises the step of axially offsetting the plurality of the pairs of blades.

4. A method according to claim 1, further comprising the step of adding mass to, or removing mass from, the bladed rotor assembly in one or more correction planes positioned along the geometric rotation axis of the bladed rotor assembly to provide a supplementary balancing correction.

5. A method according to claim 1, wherein the bladed rotor assembly is a turbine assembly, a compressor assembly, or a fan assembly for a gas turbine.

* * * * *